US006413120B1

(12) United States Patent
Winings et al.

(10) Patent No.: US 6,413,120 B1
(45) Date of Patent: Jul. 2, 2002

(54) LOW PROFILE DOUBLE DECK CONNECTOR WITH IMPROVED CROSS TALK ISOLATION

(75) Inventors: Clifford L. Winings, Etters; Robert E. Marshall, Elizabethtown; John M. Spickler, Marietta, all of PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/520,456

(22) Filed: Mar. 8, 2000

Related U.S. Application Data

(63) Continuation of application No. 08/816,846, filed on Mar. 13, 1997, now Pat. No. 6,068,520.

(51) Int. Cl.[7] ..... H01R 24/00

(52) U.S. Cl. ..... 439/676; 439/540.1; 439/541.5; 439/941; 439/79

(58) Field of Search ..... 439/676, 941, 439/540.1, 701, 541.5, 638, 79

(56) References Cited

U.S. PATENT DOCUMENTS

| | | | | |
|---|---|---|---|---|
| 4,103,985 A | | 8/1978 | Krolak et al. | 439/676 |
| 4,438,998 A | | 3/1984 | Myers | 439/638 |
| 4,444,451 A | | 4/1984 | Myers | 439/638 |
| 4,628,410 A | * | 12/1986 | Goodman et al. | 439/79 |
| 4,718,867 A | | 1/1988 | Seidel et al. | 439/609 |
| 4,772,224 A | | 9/1988 | Talend | 439/607 |
| 4,802,860 A | * | 2/1989 | Kikuta | 439/79 |
| 4,865,561 A | | 9/1989 | Collier et al. | 439/391 |
| 4,909,757 A | | 3/1990 | Reed | 439/532 |
| 5,092,785 A | | 3/1992 | Chen | 439/638 |
| 5,096,442 A | | 3/1992 | Arnett et al. | 439/676 |
| 5,131,866 A | | 7/1992 | Bodenweiser | 439/532 |
| 5,244,402 A | | 9/1993 | Pasterchick et al. | 439/217 |
| 5,308,260 A | | 5/1994 | Johnston et al. | 439/344 |
| 5,328,390 A | | 7/1994 | Johnston et al. | 439/638 |
| 5,378,172 A | | 1/1995 | Roberts | 439/607 |
| 5,425,172 A | | 6/1995 | Carswell et al. | 29/884 |
| 5,449,299 A | | 9/1995 | Shimirak et al. | 439/417 |
| 5,456,619 A | | 10/1995 | Belopolsky et al. | 439/676 |
| 5,496,195 A | | 3/1996 | Reed | 439/607 |
| 5,531,612 A | | 7/1996 | Goodall et al. | 439/541.5 |
| 5,562,507 A | | 10/1996 | Kan | 439/676 |
| 5,639,267 A | | 6/1997 | Loudermilk | 439/701 |
| 5,700,167 A | | 12/1997 | Pharney et al. | 439/676 |
| 5,773,763 A | | 6/1998 | Stachulla | 439/540.1 |
| 6,234,832 B1 | * | 5/2001 | Belopolsky et al. | 439/676 |

FOREIGN PATENT DOCUMENTS

| | | |
|---|---|---|
| DE | 295 19 934 | 4/1996 |
| EP | 0 080 772 A1 | 11/1982 |
| EP | 0 634 817 A2 | 7/1994 |
| WO | 97/10625 | 3/1997 |

* cited by examiner

*Primary Examiner*—Tho D. Ta
(74) *Attorney, Agent, or Firm*—Woodcock Washburn LLP

(57) ABSTRACT

An RJ series modular jack receptacle. The receptacle could comprise: a housing having a mating face and a circuit substrate engaging face; first and second openings in the mating face, arranged in stacked relation, the height of the housing being less than about 0.9 inch; and contact terminals in each of the openings positioned to mate with mating RJ series plugs inserted into the openings. The receptacle could also comprise: a housing with first and second openings, contact terminals in the first opening; and contact terminals in the second opening positioned relative to the contact terminals in the first opening so as to produce an acceptable level of cross-talk therebetween, such as −40 dB. The receptacle could comprise: a housing with first and second openings; and contact terminals. Adjacent contact terminals maintain a centerline distance, and the offset between the first opening and the second opening is a function of the centerline distance of the contact terminals.

27 Claims, 9 Drawing Sheets

LOW PROFILE DOUBLE DECK CONNECTOR WITH IMPROVED CROSS TALK ISOLATION

CROSS-REFERENCE TO RELATED APPLICATIONS

This application is a continuation of U.S. patent application Ser. No. 08/816,846, filed on Mar. 13, 1997 and issued as U.S. Pat. No. 6,068,520, herein incorporated by reference.

BACKGROUND OF THE INVENTION

1. Field of the Invention:

This invention relates to connectors and particularly to low profile, multiple deck connectors with improved cross talk isolation.

2. Brief Description of Prior Developments:

As a way of increasing the density of connectors, particularly telecommunications and data communications connectors, the concept of ganging receptacle connectors together in a common housing has been proposed. Placing rows of ganged connectors in stacked relationship has also been proposed. Such arrangements have been particularly prevalent in the telecommunications and data communications fields, in which FCC standardized RJ series modular jacks are commonly used.

As the number of I/O ports incorporated into each piece of equipment has increased, designers have sought ways to increase the number of ports present in a given space and minimize the amount of circuit board space required for the receptacles. One limiting factor on the effort to bring I/O ports closer together has been the need to maintain cross talk between ports (as well as within ports) at acceptable low levels, to maintain signal transmission integrity through the connector. Meeting cross talk specifications has been rendered more difficult by the ever increasing frequency of the transmitted signals, resulting especially from the drive toward higher and higher data transmission rates. To address cross talk considerations, the approaches have been to provide metal shields between the terminals of adjacent ports or maintain spatial distances between signal lines of the ports. This thwarts efforts to pack ports closer together. Other arrangements for minimizing cross talk utilize specially configured terminals that either follows circuitous routes through the connector or employ lengthy parallel paths to cancel cross talk. These latter mentioned efforts increase the complexity of the connector and raise its manufacturing cost.

SUMMARY OF THE INVENTION

The present invention relates to an RJ series modular jack receptacle having a housing with a height of less than about 0.9 inch. The housing has a mating face and a circuit substrate engaging face. The mating face includes first and second openings arranged in stacked relation. The contact terminals extend into respective openings in the housing and are positioned to mate with RJ series plugs inserted into the openings. Such an arrangement of the present invention minimizes the height of the connector above the circuit substrate.

The present invention also relates to a controlled cross-talk RJ-series modular jack receptacle, comprising: a housing having a height of less than approximately 0.9 inch; contact terminals in the first opening; and contact terminals in the second opening. The housing has a mating face with a first opening stacked relative to a second opening; and a circuit substrate engaging face. The contact terminals in the second opening are positioned relative to the contact terminals in the first opening so as to produce an acceptable level of cross-talk therebetween.

The present invention also relates to an electrical connector, comprising: a housing; and a plurality of contact terminals. The housing has a first opening for receiving a mating connector; and a second opening for receiving a mating connector. The second opening is offset from and overlapping the first opening. The contact terminals are positioned in the housing at a location medial to the first and second openings, are associated with one of the first and second openings and have a centerline distance between adjacent contact terminals. The offset between the first opening and the second opening is a function of the centerline distance.

The present invention also relates to a method of reducing cross-talk in an electrical connector, comprising the steps of: providing a housing having a first opening and a second opening located above the second opening; placing a plurality of first contact terminals in the housing; associating the first contact terminals with the first opening; placing a plurality of second contact terminals in the housing and relative to the first contact terminals; associating the second contact terminals with the second opening; and offsetting the second contact terminals a distance from the first contact terminals.

DETAILED DESCRIPTION OF THE PREFERRED EMBODIMENTS

The invention is described in the context of a modular jack receptacle configured for standardized RJ 45 series eight position plugs. The invention is particularly useful for Ethernet systems wherein two pairs of terminal contacts, or four out of the eight positions, are utilized for signal transmission. However, the invention is considered to be useful for connectors of other styles and configurations.

Figure 1:
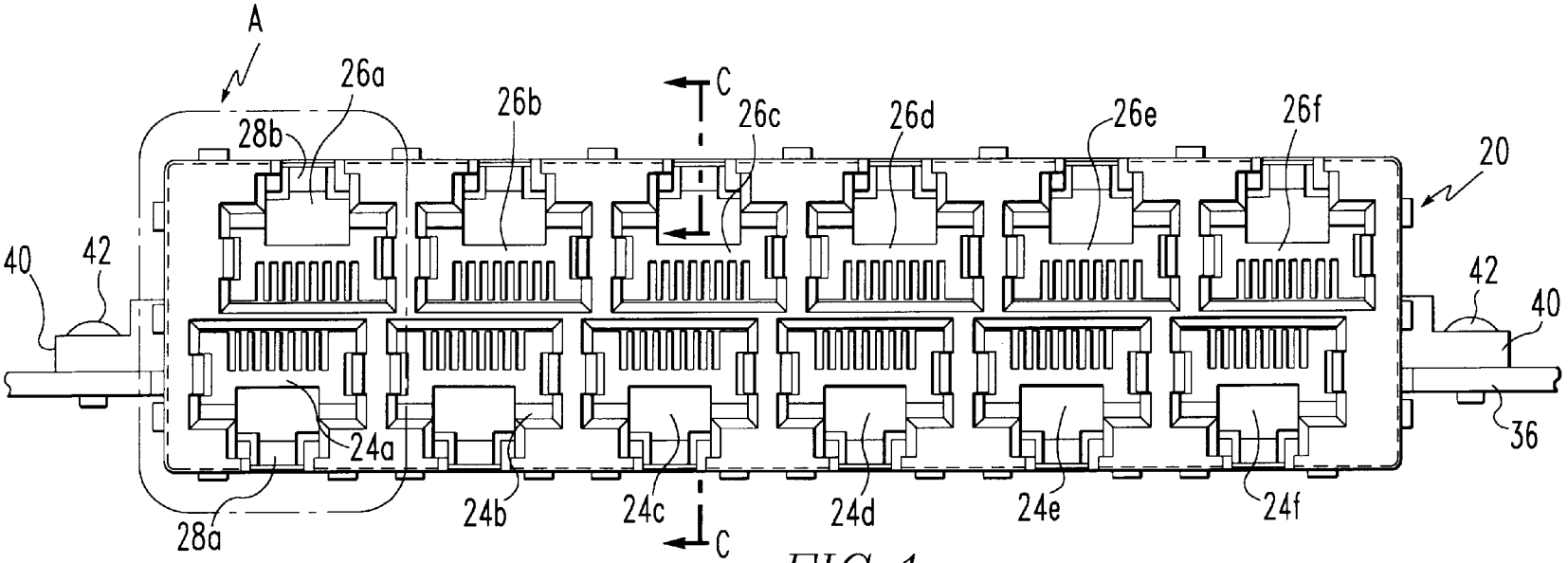
FIG. 1 is a front elevational view of a ganged modular jack receptacle embodying the invention.

As illustrated in FIG. 1, the illustrated embodiment of the connector 20 comprises a housing body 22, preferably formed of a molded insulating polymeric material. As illustrated, the body 22 includes a lower row of openings or ports 24*a*–24*f* shaped to receive a suitable mating connector such as an RJ 45 plug. A second or upper row of openings or ports 26*a*–26*f* are arranged in stacked relationship with respect to the lower openings. As is conventional, each of the openings includes a latch receiving recess 28*a*, 28*b* for receiving a latch associated with each plug.

Figure 2:
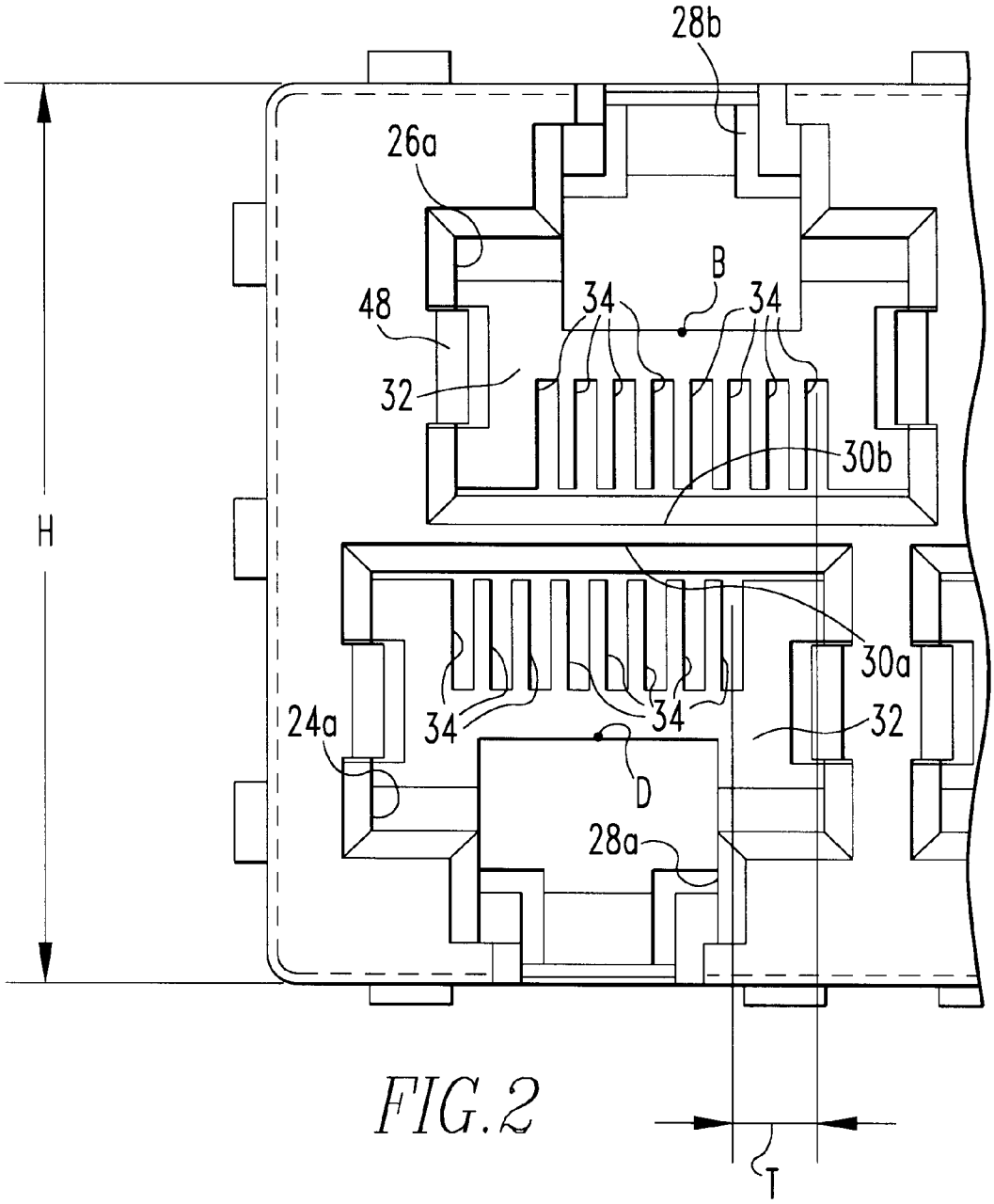
FIG. 2 is a fragmentary enlarged view of the portion of the jack of FIG. 1 within area A.

As shown in further detail in FIG. 2, the lower opening 24*a* and upper opening 26*a* are positioned with their bases 30*a*, 30*b* adjacent each other. In a preferred form, the openings 24*a* and 26*a* are positioned in a manner such that the overall height H of a two row connector is less than one inch and preferably is on the order of 0.87 inches. The manner in which this low height is achieved is explained later.

Continuing to refer to FIG. 2, each opening or port has a back wall 32 extending transversely and generally perpendicular to the plug insertion axes B and D. Each of the walls includes a plurality of generally parallel and vertically extending grooves 34 that form a comb structure adjacent the bases 30*a*, 30*b*, respectively, of each opening. The grooves 34 receive the distal ends of mating portions of contact terminals as will be later described. The terminals are not illustrated in FIGS. 1 and 2 for purposes of drawing simplicity. The numerals 1, 2, 3, and 6 appearing on the back wall of each of the cavities in FIG. 2 denote the positions of the grooves that receive terminals utilized for signal transmission in each port for Ethernet applications. The eight port positions are numbered serially from left to right in the bottom port 24*a* and from right to left in upper ports 26*a*. Terminals used for other than signal transmission may be received in the numbered slots (positions 4, 5, 7 and 8), as will later be described.

As shown in FIGS. 1 and 2, each of the upper row openings, such as opening 26*a*, is laterally offset by an amount T from an adjacent opening 24*a* in the lower row. This lateral offset accommodates the use of a single array of contact terminals with a first group of terminals of the array disposed in the lower opening 24*a* and a second group of the terminals being disposed in the upper opening 26*a*. In certain arrangements later described, one or more of the terminals of the first group can be interleaved with contact terminals of the second group.

If the openings are configured for RJ 45 series plugs wired for Ethernet applications, a preferable dimension for the offset T is about 0.08 inches, which is twice the center line distance between adjacent terminals in an eight position plug. While an offset of 0.08 inches yields adequate cross talk minimization (especially between the differential pairs utilizing port position 3 and port position 6 in adjacent ports) and is convenient from a manufacturing point of view because it is an even multiple of the center line distances between terminals, somewhat larger offsets may optimize cross talk reduction.

Figure 3:
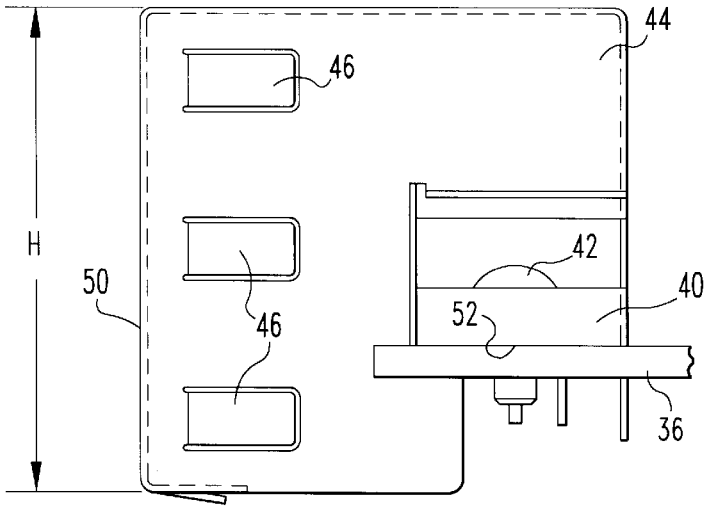
FIG. 3 is a side elevational view of the connector shown in FIG. 1.
Figure 4:
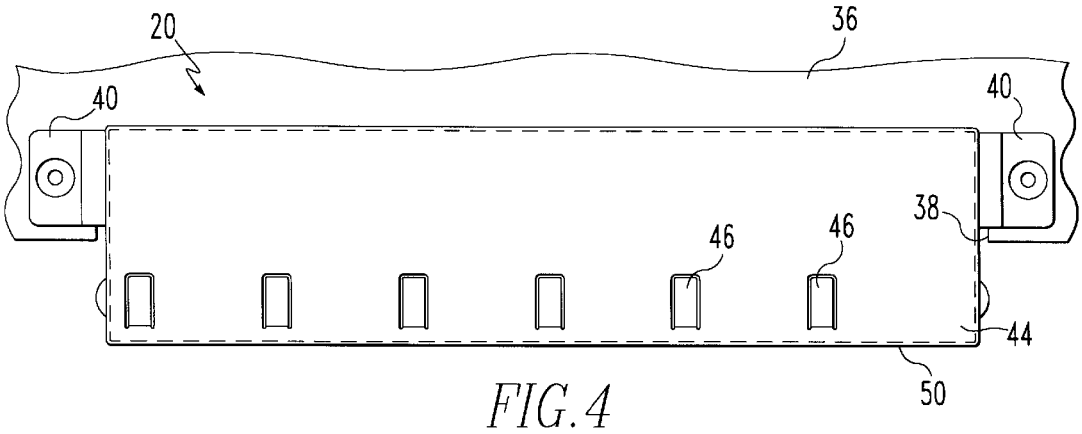
FIG. 4 is a top plan view of the connector shown in FIG. 1.

As shown in FIGS. 3 and 4, the connector 20 is mounted along an edge of the circuit board 36 and is at least partially received within a rectangular cut out 38 dimensioned to receive a portion of the connector. The connector is supported on mounting lugs 40 and is secured to the circuit board or substrate 36 by the fasteners 42. The illustrated mounting arrangement shows only one of many ways by which the connector can be mounted on a circuit substrate.

As is conventional, the connector 20 can include a sheet metal shield 44 to provide EMI shielding. Spring fingers 46 may be formed in the shield for engaging the edges of an opening in an equipment panel (not shown) through which the mating face 50 of the connector extends. As is also conventional, the shield can include face tabs 48 (FIG. 2) that extend into the openings to aid in holding the front face of the shield on the connector body 22.

The underside 52 of the lugs 40 may define a mounting interface along which the connector is mounted to the circuit substrate 36.

Figure 5:
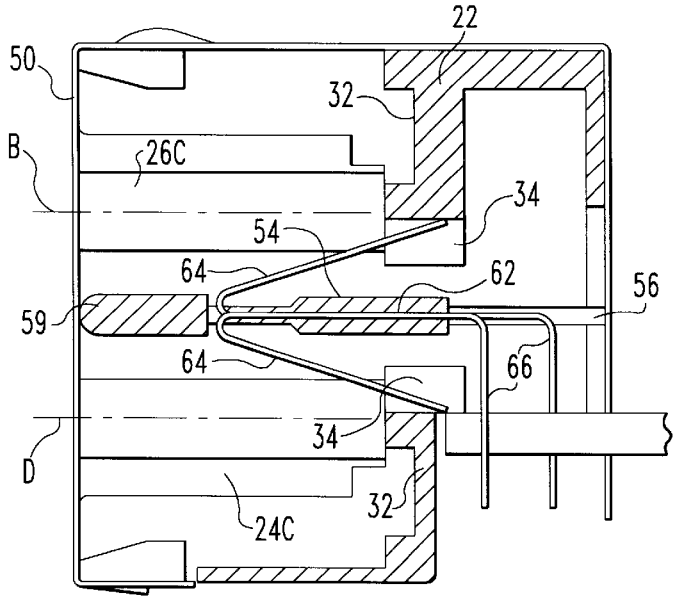
FIG. 5 is a side cross sectional view taken along line CC of FIG. 1.

In FIG. 5, a preferred arrangement for retaining contact terminals within the housing 22 is shown. In this arrangement, a linear array of contact terminals 60 (FIG. 6) is positioned generally centrally within the housing 22 in alignment with the web 59 formed between the lower opening 24*c* and the upper opening 26*c*. The terminals 60 are formed of stamped material or wire having a hardness sufficient to impart springiness to the material. As shown, the array includes ten terminals that are held in mutual spaced relation by a terminal retaining insert 54.

Figure 6:
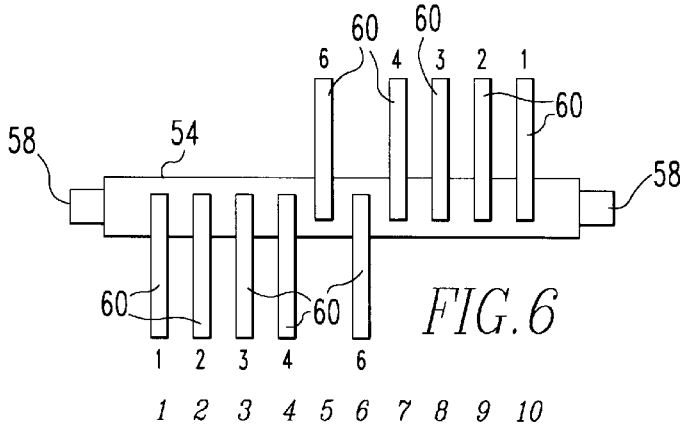
FIG. 6 is a front elevational view of a contact terminal assembly shown in FIG. 5.
Figure 12:
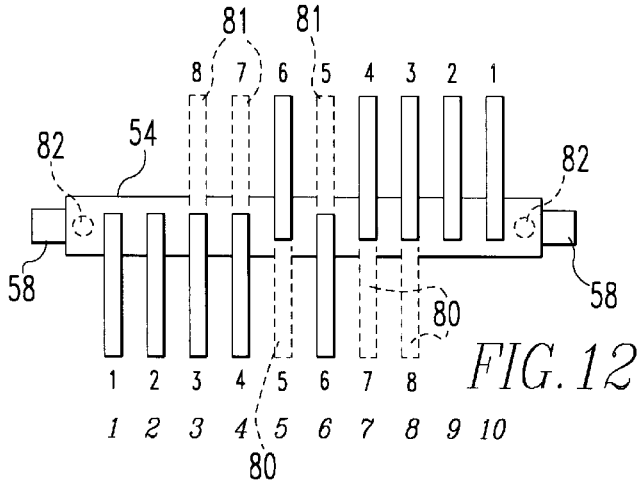
FIG. 12 is a front view of a contact terminal assembly showing the positions of signal terminals and commoned terminals.

In FIGS. 6 and 12, the numerals 1–10 in italics denote the positions of the terminals in each terminal retaining member 54. In FIG. 12, the rows of numerals adjacent the contact terminal 60 denote the terminal position within each opening. The member 54 may have the terminals inserted into it or may be insert molded about the terminals 60. The terminal retaining member 54 preferably includes an opposed pair of ribs 58 (FIG. 6) extending along opposed ends thereof. The ribs are designed to be slidingly received in a pair of opposed grooves, one of which grooves 56 is shown is FIG. 5. By reason of this arrangement, the insert 54 can be slid into position within the housing, with portions of the terminals extending into one or the other of the openings 24*c*, 26*c*.

Each of the terminals 60 (FIG. 6) includes a mid portion 62, that are maintained in substantially coplanar position by the insert member 54. Each contact terminal includes a mating portion 64, which in the illustrated embodiment comprises a bent, cantilevered portion extending from one end of each terminal mid portion 62. As shown, the portions 64 are formed by bending the distal portion of the contact to form the mating portion 64, the end of each one of which is retained within an appropriate groove 34 in the back wall 32. As is conventional, a desired amount of preload is placed on the mating portion 64 when they are placed within the grooves 34.

As shown in FIG. 6, the mating portions 64 are bent either upwardly or downwardly so that they enter the openings 26*c* or 24*c* respectively. In the illustrated arrangement, a first group of contacts has the mating portion 64 bent downwardly to enter the opening 24*c*. This group comprises the terminal contacts at terminal retainer positions 1, 2, 3, 4 and 6. A second group of mating portions is bent upwardly and as illustrated comprises the terminals at terminal retainer positions 5, 7, 8, 9 and 10. For Ethernet usage, the terminals at terminal retainer positions 1, 2, 3, 6 and 5, 8, 9 and 10 are utilized for signal transmission. Terminals at retainer positions 4 and 7 may be for other purposes, such as power or ground. In the illustrated arrangement, the terminals of the two groups at retainer positions 4, 5, 6 and 7 are interleaved.

Figure 7:
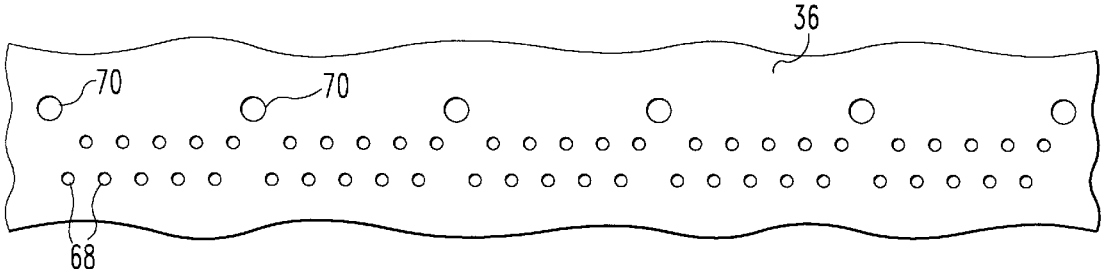
FIG. 7 is a fragmentary portion of a circuit board showing the location of a recommended layout for through holes to receive terminals of the connector shown in FIGS. 1–5.

As shown in FIG. 5, each of the terminals 60 has a tail section 66 extending from the other end of the mid portion 62. In the embodiment shown in FIG. 5, the tails 66 comprise through hole pins that are designed to be received in plated through holes 68 formed in the circuit substrate 36. Plated through holes 70 are arranged to receive pins from the shield 44. Referring to FIG. 7, the numerals adjacent through hole 68 show a preferred arrangement for receiving the through hole tails 66 of terminal contacts 60.

Figure 8:
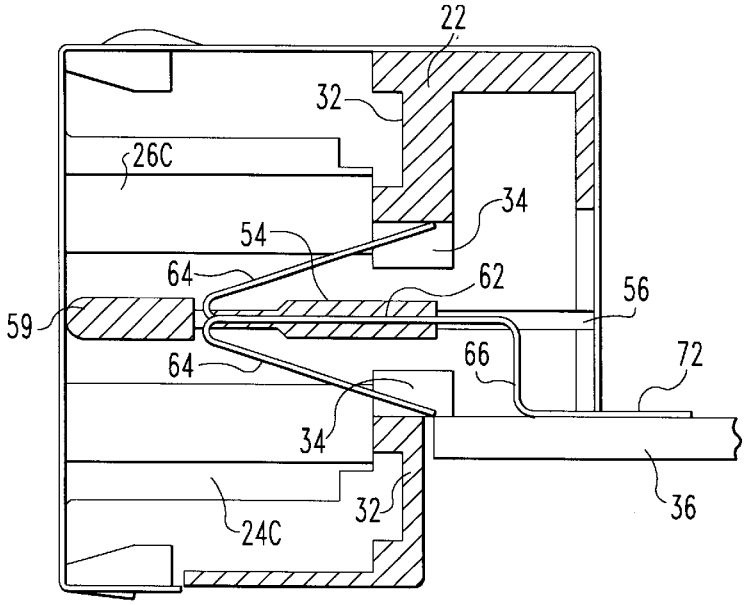
FIG. 8 is a side cross sectional view of a second embodiment similar to the embodiments of FIG. 5 but having contact terminals with surface mount tails.
Figure 9:
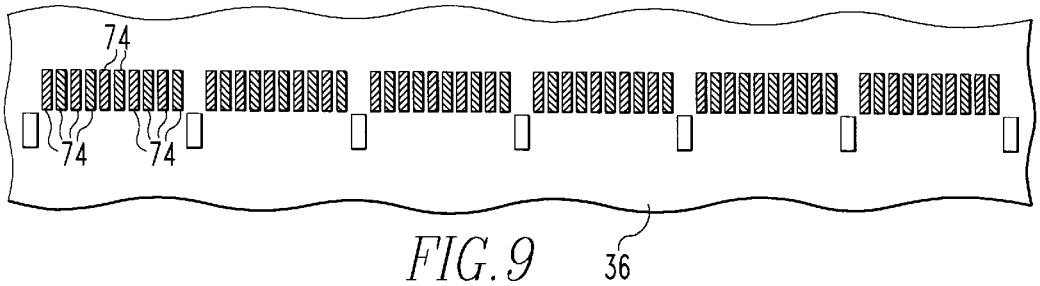
FIG. 9 is a recommended circuit board layout for use with the connector shown in FIG. 8.

Referring to FIG. 8, a surface mount embodiment of the connector 20 is illustrated. In this embodiment, the primary difference with the embodiment illustrated in FIG. 5 is that each contact tail 66 includes surface mount tabs 72 adapted to be surface mounted on surface mount contacts 74 (FIG. 9) of the circuit substrate 36. An important advantage of the arrangement shown in FIG. 8 is that the tails 66 and surface mount tabs 72 for both the lower opening 24*c* and the upper opening 26*c* can be arranged in a single line, as only ten tabs 72 need to be accommodated in the area behind each pair of upper and lower ports. This latter feature arises from the fact that the contact terminals for the upper and lower decks are at least partially interleaved and, for Ethernet purposes, certain of the unused terminals of the conventional RJ45 eight terminal array can be eliminated. The single line arrangement of surface mount tails results in a reduction in the amount of space on the circuit substrate 36 necessary to accommodate the surface mounting tabs 72.

In certain applications, it may be advantageous to provide ground contact terminals that are commoned in order to achieve improved EMI or cross talk performance. The commoned terminals may be located in port positions not utilized for signal transmission and for which there is no corresponding contact among the ten contact terminals 60 secured in the retaining member 54.

Figure 10:
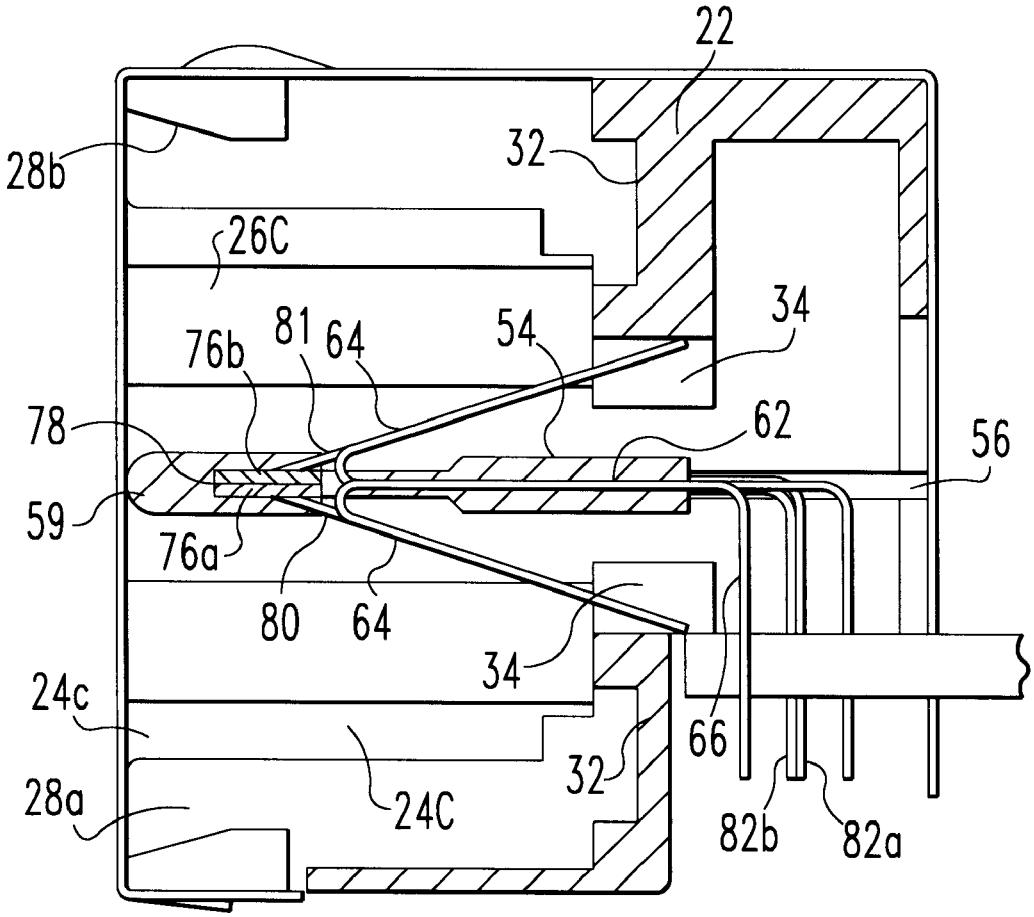
FIG. 10 is a side cross sectional view similar to FIG. 5 showing the incorporation of a commoning arrangement for certain contact terminals.
Figure 11A:
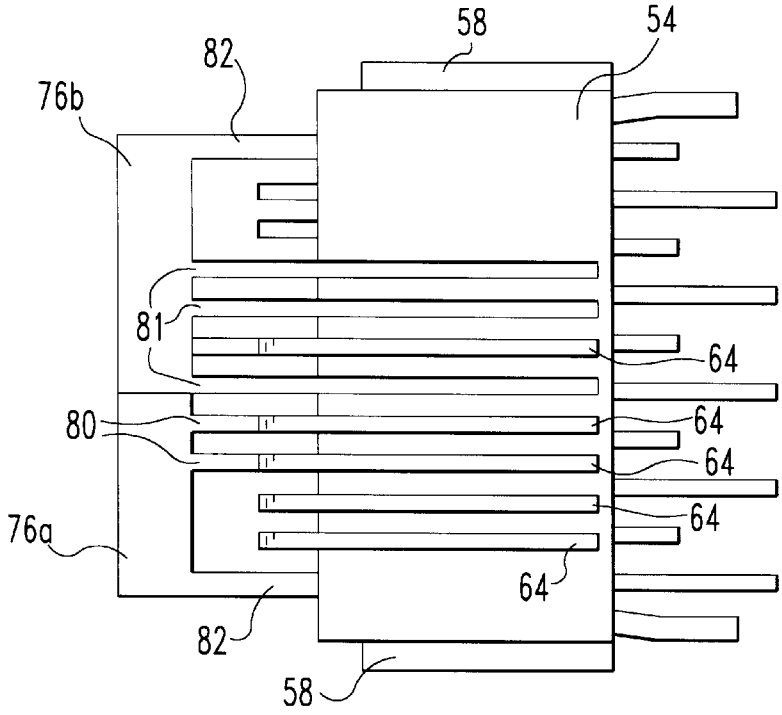
FIG. 11*a* is a top view of a terminal carrier with signal and commoned ground terminals.

FIGS. 10 and 11*a* illustrate one embodiment for satisfying this requirement. In this arrangement, bus strips 76*a* and 76*b* carry one or more terminals 80, 81 that are to be received in the lower or upper ports or openings respectively. These terminals 80, 81 are bent with respect to the bus strips 76*a*, 76*b* upwardly or downwardly as shown by terminals 80 and 81 in FIG. 10. The commoned terminals can be formed from a flat blank 90 (FIG. 11*b*), which includes terminal tail 82 for connecting the commoned terminals to the circuit substrate through an additional plated through hole.

Figure 11B:
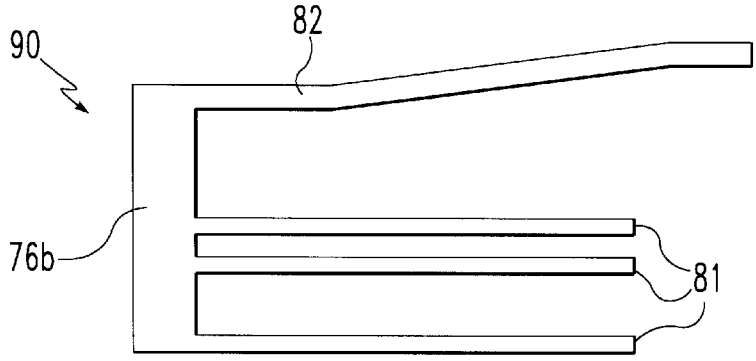
FIG. 11*b* is a top view of a blank having a set of commoned ground terminals.

As shown in FIG. 11*b*, the stamped member 90 comprises the bus strip 76*b* and terminals 81. The tails 82 are retained in the retaining member 54 (FIG. 11*a*). To form commoned terminals 80 for the lower opening, another stamping 90 is inverted and placed immediately below and offset with respect to the top stamping (See FIGS. 10 and 11). The overlapping portions of bus strips 76*a*, 76*b* may be joined together, as by welding or soldering. As the retaining member is inserted into the housing along grooves 56, the bus strips 76*a*, 76*b* are received in a groove 78 formed in a rear surface of the web 59.

In Ethernet applications, the three non-signal terminal positions 5, 7 and 8 in each of the ports can be commoned and used for other purposes such as power or grounding, by use of the stampings 90. In this case, the contact terminals at port positions 4 in each pair of stacked ports (i.e., positions 4 and 7 of the ten terminal array associated with each terminal retaining member 54) comprise individual terminals formed in the manner previously described, that can also be used for other purposes, including as power or ground contacts.

As an alternative to the configuration shown in FIG. 6, the terminals at locations 4 and 7 of the array can be bent in the same direction, so that they are both in either an upper or lower port. With this configuration, the 4, 7 pair can provide additional functionality, for example, they can be used for telephone communication.

FIG. 12 shows a contact terminal insert 54 for use in Ethernet applications having commoned terminals. The commoned terminals 80 for the lower opening are shown in phantom at lower port positions 5, 7 and 8. The commoned ground terminals 81 for the upper openings are shown in phantom at upper port positions 5, 7 and 8. The position of tails 82 is shown in phantom. Alternatively, terminals at retainer positions 4 and 7 (i.e., upper and lower port positions 4) could also be incorporated into the stampings 90, for commoning with the other nonsignal terminals.

Figure 13:
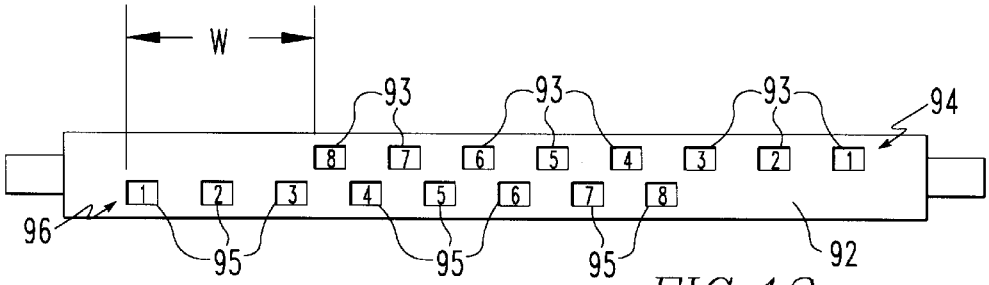
FIG. 13 shows another form of terminal arrangement embodying the invention.

FIG. 13 illustrates the cross section of another arrangement of contact terminals secured within an insulative contact retaining member 92. In this embodiment, two rows 94, 96 of contact terminals are secured on the retaining member 92. The mid portions 93 of the upper row 94 are preferably substantially coplanar, as are the mid portions 95 of the terminals in the bottom row 96. The upper coplanar array of terminals 93 forming row 94 is laterally offset by an amount W from the coplanar array of terminals 95 forming row 96. The offset W provides separation between terminals of each row that can be optimized to improve near end cross talk performance. The amount of offset W needed to optimize cross talk performance would be dependent upon pair assignments within the jacks and mating plugs.

The offset allows the rows 94 and 96 to be placed close together and may eliminate the need for a shield between the rows, thereby minimizing the height of retaining member 92. As a consequence, member 92 having a reduced height can be located between stacked offset ports and the overall height of the housing can be minimized, as in the previously described embodiments.

Figure 14:
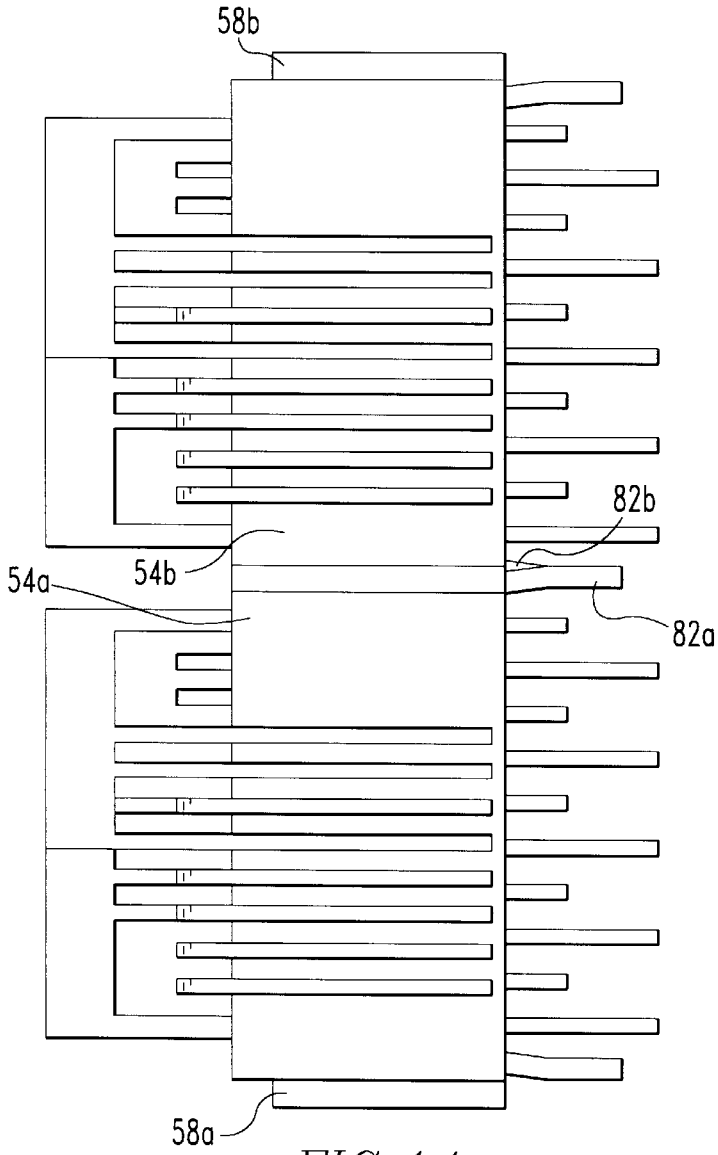
FIG. 14 is a top view of two adjacent terminal retaining members with terminal commoning features.
Figure 15:
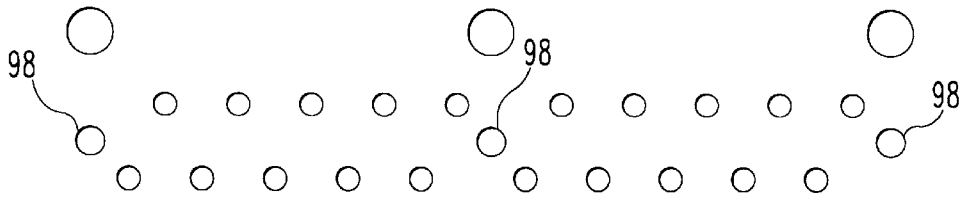
FIG. 15 illustrates a hole pattern in a circuit substrate for receiving terminal tails from the arrangement shown in FIG. 14.

Referring to FIG. 14, a preferred way of routing the tails 82 is to have the tail 82*a* along an edge of one of the retaining members 54*a* substantially overlapping the tail 82*b* of the next adjacent retaining member 54*b* (see also FIG. 10) in the region where the tails are bent downwardly toward the mounting interface of the connector. The distal portions of tails 82*a*, 82*b* can be placed into a common through hole, such as the holes 98 shown in the through hole layout of FIG. 15.

To aid in this placement of the tails, the ribs 58*a* and 58*b* are offset vertically, so that the ribs of adjacent terminal retaining members 54*a*, 54*b* can overlap, thereby allowing the terminal retaining members to be placed closely adjacent each other in side by side relationship. This allows the tails 82*a*, 82*b* to be placed more easily in overlapping relationship. Of course, to accommodate this construction, the grooves 56 associated with each stacked pair of ports also must be offset in the direction of the height of the stack.

From the foregoing description, several advantages are forthcoming. The height of the housing can be minimized to dimensions well below one inch by utilizing a single contact array and by the elimination of metal shields between the stacked openings (i.e. the stacked openings are unshielded). The reduction in housing height is accomplished while maintaining cross talk performance at Category 5 levels. Typically, near end cross talk isolation exceeding −40 dB between the stacked jackets can be achieved in arrangements Further, by the use of a single contact array containing the contacts for both stacked jacks, and by eliminating unnecessary contact terminals and interleaving remaining terminals, single line contact tail arrangements can be achieved. This results in a reduction of circuit board space utilized by the connector. Further, the use of a single contact array and retainer lessens the number of parts, simplifies assembly and results in reduced manufacturing costs.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An RJ series modular jack receptacle, comprising:

a housing having a mating face and a circuit substrate engaging face;

first and second openings in the mating face, arranged in stacked relation, the height of the housing being less than about 0.9 inch; and contact terminals in each of the first and second openings positioned to mate with mating RJ series plugs inserted into the openings and wherein at least one of the contact terminals in the first opening is interleaved with at least one of the contact terminals in the second opening.

2. The receptacle as recited in claim 1, wherein the height of the housing is about 0.87 inches.

3. The receptacle as recited in claim 1, wherein each of the contact terminals includes a tail portion for engaging a circuit substrate on which the connector is mounted, all of the tail portions being arranged in a single line.

4. The receptacle as recited in claim 1, wherein the contact terminals are arranged in an array and are divided into two groups, a first group having mating terminal portions disposed in the first opening and the second group having mating terminal portions disposed in the second opening.

5. The receptacle as recited in claim 4, wherein said first group is unshielded relative to said second group.

6. The receptacle as recited in claim 4, wherein said first and second groups extend through said housing without an air gap therebetween.

7. The receptacle as recited in claim 4, wherein the array of contact terminals is a substantially coplanar array located between the openings.

8. The receptacle as recited in claim 7, wherein the array of contact terminals comprises ten terminals, the first, second, third and sixth with terminals of the array comprising the first group and the fifth, eighth, ninth and tenth terminals of the array forming the second group.

9. The receptacle as recited in claim 8, wherein the fourth terminal of the array is in the first group and the seventh terminal of the array is in the second group.

10. The receptacle as recited in claim 1, wherein the housing includes a plurality of first openings aligned in a first row and a plurality of second openings aligned in a second row, the first row and the second row being in stacked relation.

11. The receptacle as recited in claim 10, wherein the openings in the first row are laterally offset from the openings in the second row.

12. The receptacle as recited in claim 10, wherein each opening has a base and the bases of the openings forming the first row are disposed adjacent the bases of the openings in the second row.

13. The receptacle as recited in claim 12, wherein an array of contact terminals is disposed between each pair of first and second openings, with a first group of contact terminals from each array having mating portions extending into the first opening of the pair of openings and a second group of contact terminals having mating portions extending into the second opening of the pair of openings.

14. The receptacle as recited in claim 13, and further comprising a retainer, each array of contact terminals being carried by said retainer, said housing including structure for receiving said retainer in the housing.

15. The receptacle as recited in claim 14, wherein the retainer is slidably insertable within the housing.

16. The receptacle as recited in claim 15, wherein the retainer comprises a plurality of members, each member retaining one of said contact terminal arrays.

17. An electrical connector, comprising:

a housing, having:

a first opening for receiving a mating connector; and a second opening for receiving a mating connector, said second opening offset from and overlapping said first opening; and a plurality of contact terminals positioned in said housing at a location medial to said first and second openings, associated with one of said first and second openings and having a centerline distance between adjacent contact terminals;

wherein said offset between said first opening and said second opening is a function of said centerline distance.

18. The electrical connector as recited in claim 17, wherein said offset is approximately an even multiple of said centerline distance.

19. The electrical connector as recited in claim 17, wherein at least a portion of said contact terminals are coplanar.

20. The electrical connector as recited in claim 17, wherein said offset is a predetermined function of said centerline distance.

21. The electrical connector as recited in claim 17, wherein said offset is at least approximately twice said centerline distance.

22. The electrical connector as recited in claim 21, wherein said offset is approximately 0.08 inch.

23. A method of reducing cross-talk in an electrical connector, comprising the steps of:

providing a housing having a first opening and a second opening located above, and in an offset and overlapping relationship with said first opening;

placing a plurality of first contact terminals in said housing;

associating said first contact terminals with said first opening;

placing a plurality of second contact terminals in said housing and relative to said first contact terminals;

associating said second contact terminals with said second opening; and offsetting said second contact terminals a distance from said first contact terminals.

24. The method as recited in claim 23, wherein said offset distance is approximately an even multiple of a centerline distance between adjacent contact terminals.

25. The method as recited in claim 23, further comprising the step of placing said plurality of first and second contact terminals in a coplanar array.

26. The method as recited in claim 23, wherein said offset distance is at least approximately twice a centerline distance between adjacent contact terminals.

27. The method as recited in claim 26, wherein said offset is approximately 0.08 inch.

* * * * *